US010364626B2

(12) United States Patent
Vinson et al.

(10) Patent No.: US 10,364,626 B2
(45) Date of Patent: Jul. 30, 2019

(54) COMPOSITE FRACTURE PLUG AND ASSOCIATED METHODS

(71) Applicant: Weatherford Technology Holdings, LLC, Houston, TX (US)

(72) Inventors: Justin P. Vinson, Houston, TX (US); Matthew A. Crump, Tomball, TX (US); Chad H. Picciotti, Cypress, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 294 days.

(21) Appl. No.: 14/819,015

(22) Filed: Aug. 5, 2015

(65) Prior Publication Data

US 2016/0040492 A1 Feb. 11, 2016

Related U.S. Application Data

(60) Provisional application No. 62/033,959, filed on Aug. 6, 2014.

(51) Int. Cl.

| | |
|---|---|
| ***E21B 23/06*** | (2006.01) |
| ***E21B 23/08*** | (2006.01) |
| ***E21B 33/128*** | (2006.01) |

(52) U.S. Cl.

CPC ..... *E21B 23/06* (2013.01); *E21B 23/08* (2013.01); *E21B 33/128* (2013.01)

(58) Field of Classification Search

CPC ..... E21B 23/06; E21B 33/12; E21B 34/06; E21B 23/08; E21B 23/02

(Continued)

(56) References Cited

U.S. PATENT DOCUMENTS 4,007,783 A * 2/1977 Amancharla ..... E21B 23/02 166/135
4,390,065 A * 6/1983 Richardson ..... E21B 23/06 166/181

(Continued)

FOREIGN PATENT DOCUMENTS

WO 2012/051705 A1 4/2012

OTHER PUBLICATIONS

Weatherford, "OptiSleeve Sliding Sleeve," Brochure, copyright 2006-2011.

(Continued)

*Primary Examiner* — David J Bagnell
*Assistant Examiner* — Lamia Quaim
(74) *Attorney, Agent, or Firm* — Blank Rome LLP

(57) ABSTRACT

A plug is engageable with a ball for seating in a tubular having an internal profile. The plug's body has a bore with a seat. Blocks disposed on the body are temporarily held in a retracted condition, but the blocks are biased outward to an expanded condition for engaging inside the tubular. The plug sets in the tubular with the blocks released from the retracted condition to the expanded condition. With the ball dropped downhole, the seat engages the ball so that fluid pressure is sealed from uphole to downhole through the bore. With applied fluid pressure against the seated ball, the plug can move through the tubular until the blocks seat in the internal profile of the tubing, sliding sleeve, or other component. A seal on the plug can then seal inside the tubular while the blocks seat in the profile and applied pressure pushes on the seated ball on the plug's mandrel.

29 Claims, 14 Drawing Sheets

(58) Field of Classification Search
USPC ..... 166/89.1, 106, 118, 179, 386
See application file for complete search history.

(56) References Cited

U.S. PATENT DOCUMENTS

| | | | | |
|---|---|---|---|---|
| 5,040,600 | A * | 8/1991 | Bailey | E21B 23/06 166/182 |
| 5,046,557 | A * | 9/1991 | Manderscheid | E21B 33/1295 166/120 |
| 5,398,763 | A | 3/1995 | Watson et al. | |
| 6,976,534 | B2 | 12/2005 | Sutton et al. | |
| 7,124,831 | B2 | 10/2006 | Turley et al. | |
| 8,047,279 | B2 | 11/2011 | Barlow et al. | |
| 9,033,041 | B2 | 5/2015 | Baihly et al. | |
| 9,057,260 | B2 | 6/2015 | Kelbie et al. | |
| 9,080,439 | B2 | 7/2015 | O'Malley et al. | |
| 9,157,288 | B2 * | 10/2015 | Martinez | E21B 23/01 |
| 9,163,494 | B2 | 10/2015 | Love | |
| 9,574,415 | B2 | 2/2017 | Xu et al. | |
| 9,732,586 | B2 | 8/2017 | Love | |
| 2003/0173117 | A1 * | 9/2003 | Mason | E21B 19/10 175/423 |
| 2004/0026091 | A1 * | 2/2004 | Patel | E21B 21/10 166/386 |
| 2005/0072577 | A1 * | 4/2005 | Freeman | E21B 34/14 166/386 |
| 2009/0025923 | A1 * | 1/2009 | Patel | E21B 43/045 166/51 |
| 2010/0294484 | A1 * | 11/2010 | Castillo | E21B 33/1208 166/179 |
| 2011/0073310 | A1 * | 3/2011 | Clemens | E21B 23/01 166/285 |
| 2011/0277987 | A1 * | 11/2011 | Frazier | E21B 33/134 166/181 |
| 2014/0014371 | A1 | 1/2014 | Jacob et al. | |
| 2014/0060837 | A1 | 3/2014 | Love | |
| 2014/0202708 | A1 | 7/2014 | Jacob et al. | |
| 2015/0129229 | A1 | 5/2015 | Ring et al. | |
| 2015/0129239 | A1 | 5/2015 | Richard | |
| 2016/0305215 | A1 | 10/2016 | Harris et al. | |
| 2017/0130553 | A1 | 5/2017 | Harris et al. | |
| 2017/0342801 | A1 | 11/2017 | Love | |

OTHER PUBLICATIONS

Weatherford, "ZoneSelect MultiShift Frac Sliding Sleeve," Brochure, copyright 2009-2011.
Weatherford, "ZoneSelect® MASS Stimulation Sleeve," Brochure, copyright 2010-2013.
Weatherford, "ZoneSelect® Completions System SingleShot Stimulation Sleeve," Brochure, copyright 2013.
Weatherford, "ZoneSelect® Completions System MultiShift Sliding Sleeve," Brochure, copyright 2013.
"Baker Style #20 Setting Tool," Product Brochure, obtained from http://www.ewesl.com/Technical%20Resources/05%20Diamondback/baker_style_20_setting_tool.pdf, accessed Jul. 28, 2014.

* cited by examiner

COMPOSITE FRACTURE PLUG AND ASSOCIATED METHODS

CROSS-REFERENCE TO RELATED APPLICATIONS

This application claims the benefit of U.S. Provisional Appl. 62/033,959, filed 6 Aug. 2015, which is incorporated herein by reference in its entirety.

BACKGROUND OF THE DISCLOSURE

Fracture plugs, bridge plugs, and the like are used in a tubular to block off flow. A fracture plug is used to seal fluid pressure from above, whereas a bridge plug is used to seal from above and below. Typically, the plugs have mandrels and other components composed of a millable material, such as a composite material. Seals on the mandrels can be compressed to seal inside the tubular, and slips are typically used on the plug to engage the plug inside the casing. Once the plug has been used for its purpose, it is typically milled out in a milling operation.

In many cases, the plugs have metal slips. These metal pieces cause issues during milling, and the metallic residue may not readily flowback to the surface. For this reasons, composite plug providers have tried to reduce the amount of metal in the composite plugs.

Slips used for a composite plug can be composed of metal, such as cast iron, or they may be composed of composite materials with inserts or buttons disposed in the slip to grip the inner wall of a casing or tubular. Examples of downhole tools with slips and inserts are disclosed in U.S. Pat. Nos. 6,976,534 and 8,047,279.

As shown in FIG. 1, a typical composite plug P has a mandrel 10 with cones 14 and backup rings 16 arranged on both sides of a packing element 18. Outside the inclined cones 14, the plug P has slips 12*a-b*. The slips 12*a-b* can be a conventional wicker slip (as with slip 12*b*) composed of cast iron or can be a composite material slip (as with 12*a*) having inserts or buttons 13. The composite plug P is preferably composed mostly of non-metallic components according to procedures and details as disclosed, for example, in U.S. Pat. No. 7,124,831, which is incorporated herein by reference in its entirety. This makes the plug P easy to mill out after use.

When deployed downhole, the plug P is activated by a wireline setting tool (not shown), which uses conventional techniques of pulling against the mandrel 10 while simultaneously pushing an upper component 15, which pushes against the upper slip 12*a* and forces a head 11 against the lower slip 12*b*. The force used to set the plug P may be as high as 30,000 lbf. and could even be as high as 85,000 lbf. These values are only meant to be examples and could vary for the size of the plug.

As a result, the slips 12*a-b* ride up the cones 14, the cones 14 move along the mandrel 10 toward one another (because the components are being pushed downward on the mandrel 10 against the fixed head 11), and the packing element 18 compresses and extends outward to engage a surrounding casing wall. The backup elements 16 control the extrusion of the packing element 18. The slips 12*a-b* are pushed outward in the process to engage the wall of the casing, which both maintains the plug P in place in the casing and keeps the packing element 18 contained.

Once set, the plug P isolates upper and lower portions of the casing so that fracture and other operations can be completed uphole of the plug P, while pressure is kept from downhole locations. When used during fracture operations, for example, the plug T may isolate pressures of 10,000 psi or so. Depending on the type of plug P used, an internal ball B may be contained in the plug P, or a separate ball may be deployed to seat on the plug P.

As will be appreciated, any slipping or loosening of the plug P can compromise operations. Therefore, it is important that the slips 12*a-b* sufficiently grip the inside of the casing. At the same time, however, the plug P and most of its components are preferably composed of millable materials because the plug P is milled out of the casing once operations are done, as noted previously. As many as fifty such plugs P can be used in one well and must be milled out at the end of operations. Therefore, having reliable plugs P composed of entirely of (or mostly of) millable material is of particular interest to operators.

Wicker slips (e.g., 12*b*) are made of metal, and composite slips (e.g., 12*a*) have inserts 13 typically made from cast or forged metal. For example, the inserts 13 may also be composed of carbide, which is a dense and heavy material, or even ceramic. When a plug P having composite slips (e.g., 12*a*) with carbide inserts 13 is milled out of the casing, the inserts 13 tend to collect in the casing and are hard to float back to the surface. In fact, in horizontal wells, the carbide inserts 13 may tend to collect at the heel of the horizontal section and cause potential problems for operations. Given that a well may have upwards of forty or fifty composite plugs P used during operations that are later milled out, a considerable number of carbide inserts 13 may be left in the casing and difficult to remove from downhole. Similar issues occur of course when the slips (e.g., 12*b*) are metallic and milled out due to the metal remnants left in the well.

Various types of plugs have been used for many years as evidenced, for example, by U.S. Pat. Nos. 5,398,763 and 9,033,041. In fact, the interest in plugs for wellbore tubulars has been (and will continue) to be of vital importance to operators. To that end, the subject matter of the present disclosure is directed to overcoming, or at least reducing the effects of, one or more of the problems set forth above and to improving the types, uses, performance, and the like of plugs for wellbore tubulars.

SUMMARY

A downhole apparatus of the present disclosure can be used for a wellbore tubular having a shoulder. The apparatus includes a plug having a body, a setting element, and a packing element. The body has an exterior surface and has first and second ends. The setting element is disposed on the body toward the first end. During deployment, the setting element is at least temporarily held in a retracted condition against the exterior surface, but is biased to an expanded condition away from the exterior surface toward the wellbore tubular. In this way, the setting element in the extended condition can engage in a first direction with the shoulder in the wellbore tubular and can move with the engagement in a second, opposite direction toward the second end.

The packing element is disposed on the body toward the second end and adjacent the setting element. The packing element is compressible from an unsealed condition to a sealed condition between the body and the setting element. Initially, the uncompressed packing element in the unsealed condition remains unsealed with the wellbore tubular. However, the compressed packing element in the sealed condition seals with the wellbore tubular and isolates an annulus between the body and the wellbore tubular.

A load ring can be disposed on the body between the packing element and the setting element, and the load ring can have a temporary fixture to the body.

The setting element can have inner and outer surfaces and top and bottom ends. The inner surface faces the exterior surface of the body, and at least one of the top and bottom ends has a biasing element circumferentially biasing the setting element away from the exterior surface.

In one embodiment, the plug's body is solid. Alternatively, the body defines a bore therethrough from the first end to the second end. A seat on the second end can engage a deployed element, such as a ball, that closes off fluid communication through the body's bore.

The setting element can be setting blocks and can be a plurality of ring segments disposed about the body. In general, the body and/or the setting element of the plug is composed of a millable material, a non-metallic material, a molded phenolic, a laminated non-metallic composite, an epoxy resin polymer with a glass fiber reinforcement, a thermoplastic material, an injection-molded plastic material, a metal, a dissolvable material, and a degradable material. The packing element can be composed of an elastomeric material.

In a further embodiment of the apparatus, a setting tool is used to run the plug in the wellbore tubular and drop off the plug at a point in the tubular near the shoulder. The setting tool has first and second components with at least one of them being movable relative to the other. Both components engage the body, and the second component holds the setting element in the retracted condition. When deployed and activated, the at least one first and second component is moved, and the setting tool releases the body in the wellbore tubular. In response, the setting element is unheld by the tool's second component and expands outward in the expanded condition to the wellbore tubular.

In one arrangement, the tool's second component is an external sleeve disposed outside of the setting element. The external sleeve is movable along the outside away from the setting element. The tool's second component can also have a temporary fixture to the body. In another arrangement, the tool's second component is an internal mandrel disposed inside a bore of the body that holds against an interior portion of the setting element. During deployment and activation, the internal mandrel can move along the inside of the bore away from the interior portion of the setting element so that the setting element is no longer temporarily held in the retracted condition.

In another arrangement, the setting element has a temporary fixture holding the setting element in the retracted condition. The tool's second component has an inner mandrel disposed inside a bore of the body that engages an interior portion of the setting element. The inner mandrel moves along the inside of the bore and pushes the interior portion of the setting element. In turn, the pushed setting element breaks the temporary fixture so the setting element can expand outward to the wellbore tubular in the expanded condition.

In a further embodiment of the apparatus, a coupling disposed on the wellbore tubular has an internal profile with the shoulder. The plug is run into the wellbore tubular and engages in the internal profile of the coupling. The internal profile of the coupling can define a serrated surface. In one arrangement, a setting tool runs the plug into the wellbore tubular and releases the plug at a point uphole of the coupling. Movement of the released plug in a downhole direction then engages the plug with the internal profile.

In a further embodiment of the apparatus, at least one sleeve disposed on the wellbore tubular has an external port communicating outside the at least one sleeve. The at least one sleeve also has an insert movable in the sleeve relative to the external port. The insert has an internal profile with the shoulder of the wellbore tubular. In this arrangement, the plug runs into the wellbore tubular to the at least one sleeve and engages in the internal profile of the insert. Movement of the plug engaged in the internal profile moves the insert relative to the external port.

In one arrangement, the internal profile is fixed in the insert and has the shoulder remaining exposed. In an alternative arrangement, the internal profile of the insert has first and second conditions. For example, the internal profile in the first condition can engage with the plug such that movement of the plug in one direction moves the insert in the one direction. The internal profile in the second condition can disengage with the plug such that the plug moves independent of the insert.

In a particular configuration, the internal profile of the insert includes a key movable between the first and second conditions in a slot of the insert. The key in the first condition is retracted out from the slot to expose the shoulder for engagement with the plug. However, the key in the second condition is placed into the slot to remove the exposure of the shoulder so that the setting element does not engage the shoulder and releases from the insert. Finally, to control fluid flow at least temporarily, the external port of the sleeve can have a temporary obstruction disposed therein that at least temporarily limits fluid communication outside of the sleeve.

In a further embodiment of the apparatus, a mandrel is supported on a conveyance and supports the plug on an exterior of the mandrel. The mandrel has first and second ends and defines an intermediate passage communicating the exterior between the first and second ends with the first end of the mandrel. During deployment, the plug is temporarily held to the exterior of the mandrel and releases therefrom with fluid communicated against the plug. The plug released from the mandrel is then engageable with the internal profile of the insert, and movement of the plug with the conveyance in a first direction against the profile slides the insert relative to the external port. On the other hand, movement of the plug with the conveyance in a second, opposite direction away from the internal profile releases the plug therefrom. Passage of fluid against the plug and through the intermediate passage maintains the plug against the first end and maintains the packing element on the plug unset.

In another embodiment, a method of plugging a wellbore tubular involves deploying a plug to a point in the wellbore tubular; at least temporarily supporting the plug at the point in the wellbore tubular by releasing a setting element temporarily held in a retracted condition to an extended condition on the deployed plug; engaging the extended setting element in a first direction against a shoulder near the point in the wellbore tubular; and compressing a packing element on the plug against the engaged setting element by moving the plug in the first direction.

To deploy the plug to the point in the wellbore tubular, the plug can be run in the wellbore tubular with a setting tool on a conveyance. Releasing the setting element temporarily held in the retracted condition to the extended condition on the deployed plug can involve disengaging a portion of the setting tool from temporarily holding the setting element. To engage the extended setting element in the first direction in the profile against the shoulder near the point in the wellbore tubular, an element, such as a ball, can be seated at a bore of the plug, and fluid can be pumped against the plug with the seated element. To compress the packing element on the plug against the engaged setting element, the engaged setting element moves in a second, opposite direction along the plug. The packing element compresses from an unsealed condition with the wellbore tubular to a sealed condition with the wellbore tubular and isolates an annulus between the body and the wellbore tubular.

The foregoing summary is not intended to summarize each potential embodiment or every aspect of the present disclosure.

BRIEF DESCRIPTION OF THE DRAWINGS

FIGS. 10A-100 illustrate operation of the disclosed plug in use with another type of sliding sleeve.

DETAILED DESCRIPTION OF THE DISCLOSURE

Figure 1:
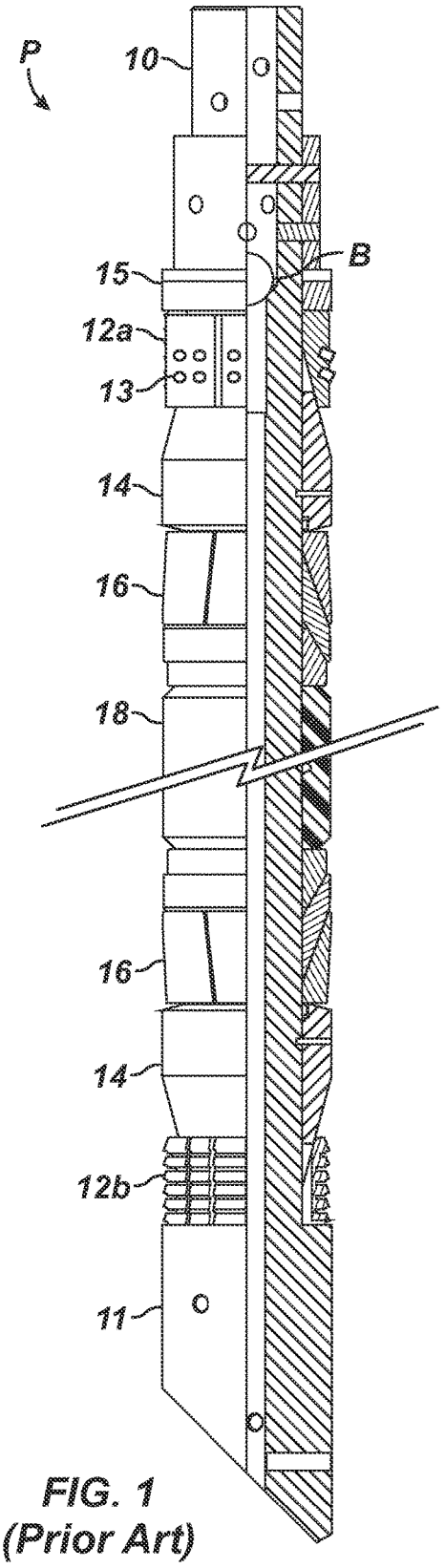
FIG. 1 (Prior Art)
FIG. 1 illustrates a plug according to the prior art in partial cross-section.
Figure 2A:
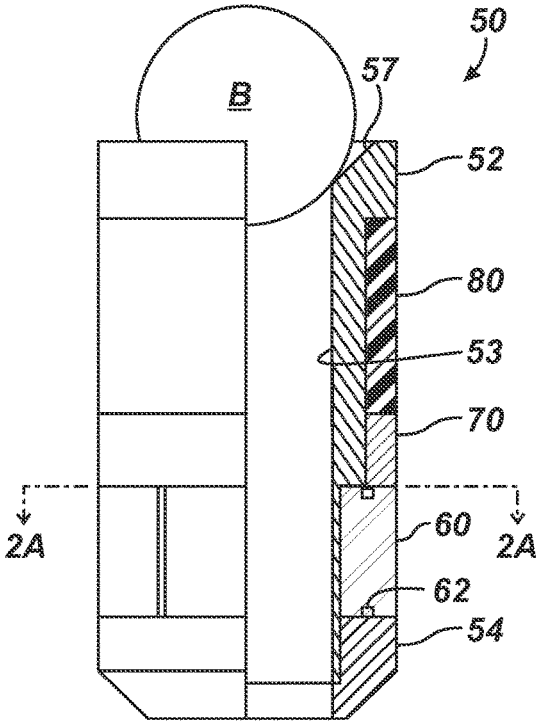
FIG. 2A illustrates the general components of a plug according to the present disclosure in partial cross-section.

FIG. 2A illustrates the general components of a plug 50 according to the present disclosure in partial cross-section. In general, the disclosed plug 50 can be used as a fracture plug intended to isolate uphole fluid pressure from passing downhole. However, the plug 50 can be used in other ways. The plug 50 includes a mandrel or body 52 having a throughbore 53 therethrough and having a seat 57 at one end. An end piece 54 affixes to the end of the mandrel 52 to hold central components on the mandrel 52. These central components include setting elements or blocks 60, an intermediate load ring 70, and a packing element 80.

As alternatives, the plug 50 need not include a throughbore 53 and seat 57 as shown, which requires a setting ball B to be used. Instead, plug 50 may have a solid mandrel 53, or the plug 50 may have an internal ball captured in a throughbore 53. Both of these configurations would alter certain aspects of the plug's use and operation in ways readily appreciated by one skilled in the art so that they are not highlighted here.

Components of the plug 50 can be composed of one or more millable, non-metallic materials, such as a molded phenolic, a laminated non-metallic composite, an epoxy resin polymer with a glass fiber reinforcement, thermoplastic material, injection-molded plastic material, etc. However, the plug 50 can be composed of metal, dissolvable material, degradable material, etc., depending on the implementation. Preferably, the mandrel 52, the end piece 54, the setting blocks 60, and the intermediate ring 70 are composed of a millable material, such as phenolic, composite, or the like. The packing element 80 may be composed of an elastomeric material.

During operations, a deployed element (e.g., a ball B) is dropped to land at the seat 57 to close off the throughbore 53. Although a ball B is shown and described, any conventional type of plugger, dart, ball, cone, bomb, or the like may be used. Therefore, the term "ball" as used herein is merely meant to be representative.

Figure 2B:
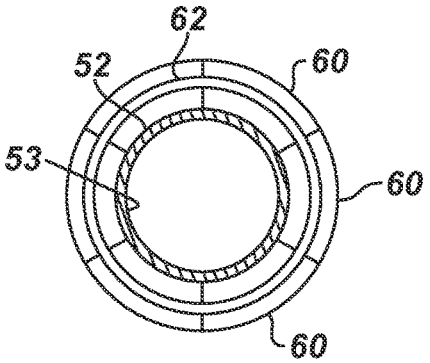
FIG. 2B is a plan view of setting elements for the disclosed plug.

As best shown in FIG. 2B, the setting blocks 60 include a plurality of ring segments. These blocks 60 are disposed about the circumference of the mandrel 52 and are biased by one or more springs 62. Preferably, these springs 62 can be disposed at the ends of the blocks 60 to bias them outward, although other configurations can be used. For example, a spring can be disposed inside the blocks 60 or at the inner surface thereof to expand the segmented blocks 60 outward from the mandrel 52.

The intermediate ring 70 is used as a push ring or shoulder for activating or containing the packing element 80. Finally, the packing element 80 can be a sleeve of elastomeric material that is compressible. Alternatively, the packing element 80 can use cup seals, chevron seals, or other sealing elements.

Figure 3A:
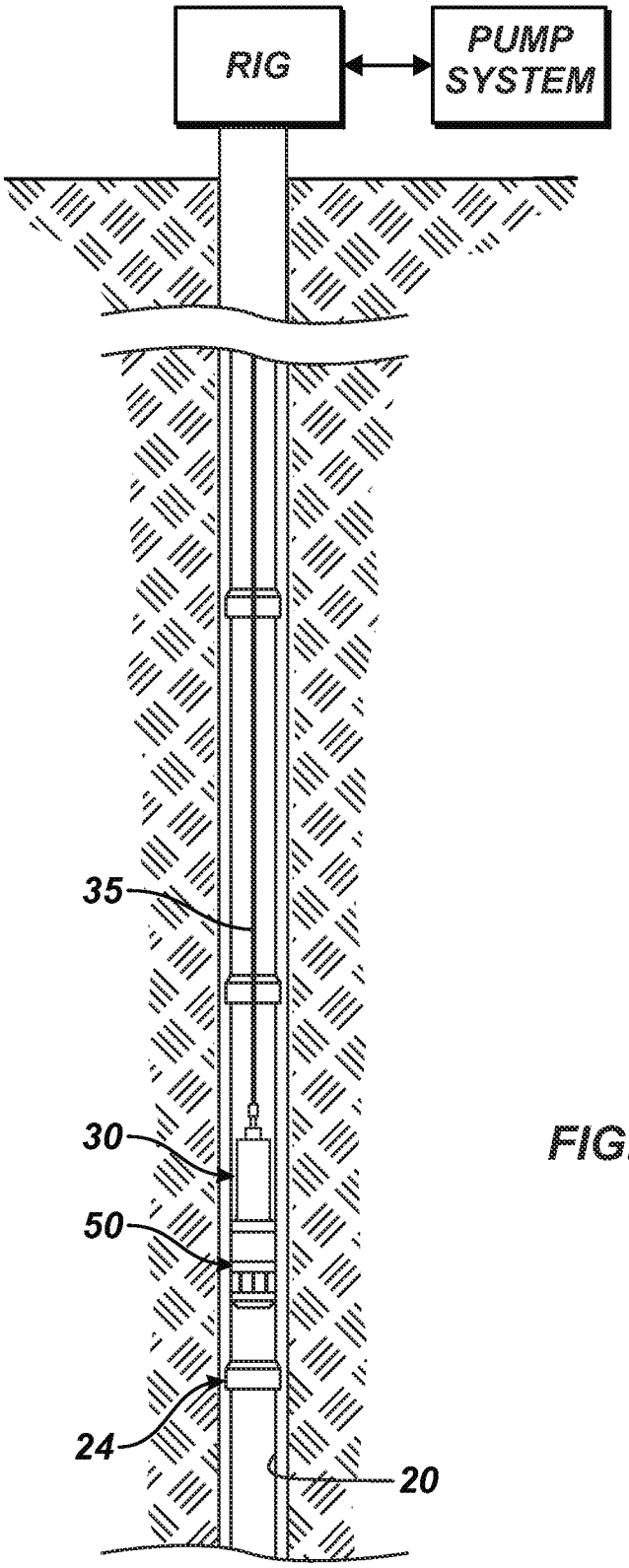
FIGS. 3A-3F illustrate the disclosed plug during run-in, drop-off, and setting of the plug.

With a general understanding of the disclosed plug 50, FIGS. 3A-3D illustrate the disclosed plug 50 during setting operations, such as during a plug and perf operation. As shown in FIG. 3A, the plug 50 is deployed downhole in a string of tubing or casing 20 on a deployment tool 30 and conveyed by a conveyance 35, such as wireline, slick line, coiled tubing, or the like.

Figure 3D:
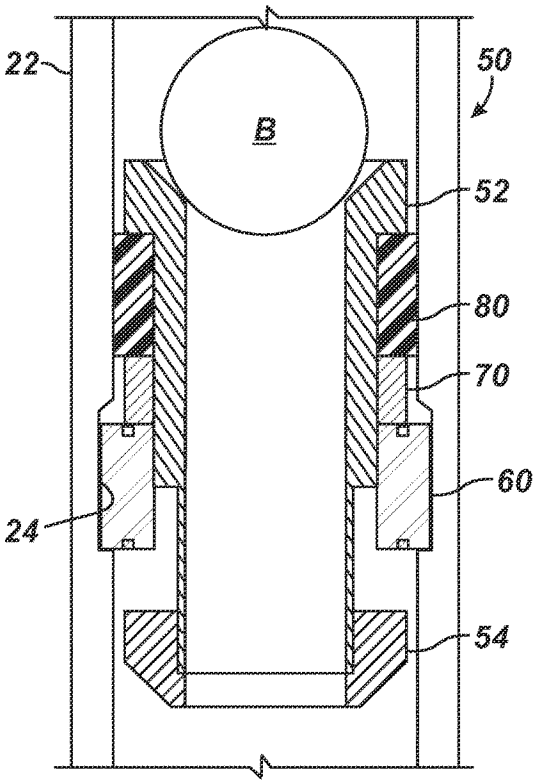
Figure 3C:
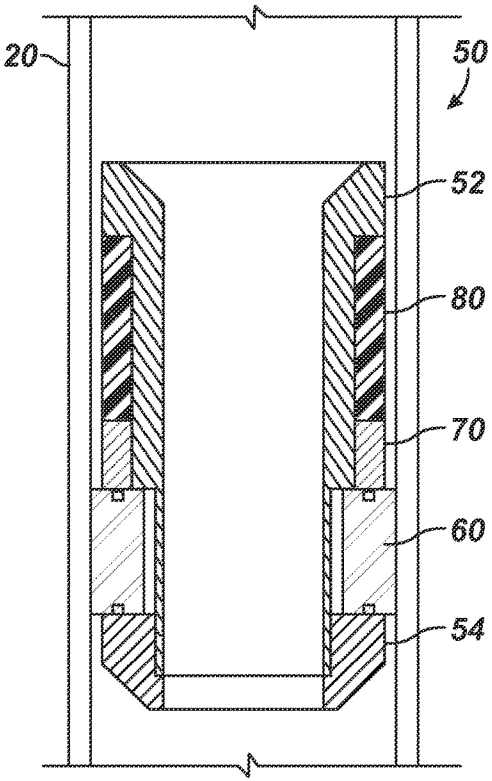
Figure 3B:
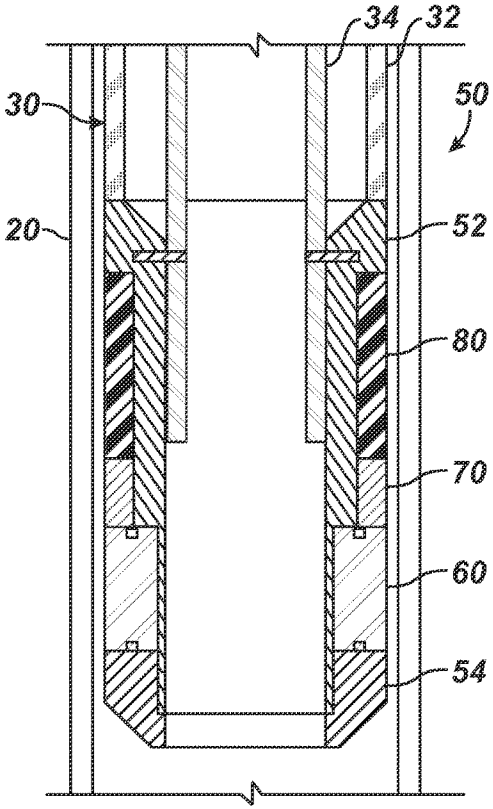

At a certain point above a profile 24 along the downhole tubing string or casing 20, the deployment tool 30 is activated to drop off the plug 50 in the casing 20. For example, the plug 50 can be deployed on wireline 35 using the deployment tool 30 to initially deploy or drop off the plug 50 in the casing 20. As shown in FIG. 3B, the deployment tool 30 can include movable sleeves, mandrels, or other elements 32, 34 that support the plug 50 and can push the plug 50 free when the tool 30 is activated. As one example, the deployment tool 30 can be an E4 style setting tool used on wireline 35 to run the plug 50 to near depth. When activated, the deployment tool 30 then releases the plug 50 into the casing 20. E4 style setting tools are known in the art and can use charges, pressure chambers, pistons, igniters, and the like to complete the release.

In releasing the plug 50, the deployment tool 30 can preferably drop the plug 50 above the ultimate profile 24 to which the plug 50 will set. Once the plug 50 is dropped off, the conveyance 35 is removed. As shown in FIG. 3C, the plug 50 once dropped off does not "set" in the casing 20 (i.e., the plug's packing 80, intermediate ring 70, and the like are not activated). Instead, the biased blocks 60 are released to expand outward against the casing 20 to act as drag blocks. This tends to holds the plug 50 in place.

Once the plug 50 is disposed in the casing 20, other steps can be performed. As shown in FIG. 3D, a ball B or similar component is deployed down the casing 20 to land on the seat 57 of the plug's mandrel 52. Pumped fluid down the casing 20 from the surface then pushes the plug 50 along the casing 20. The biased blocks 60 acting as drag blocks then eventually reach the requisite shoulder of the profile 24 and engage therein, as shown in FIG. 3D. Any pumped pressure against the seated ball B pushes against the mandrel 52 and activates the packing element 80 to create a pressure seal with the casing 30. Thus, pumped pressure sets the seal of the packing element 80 rather than a pulling setting force as conventionally done.

Figure 3E:
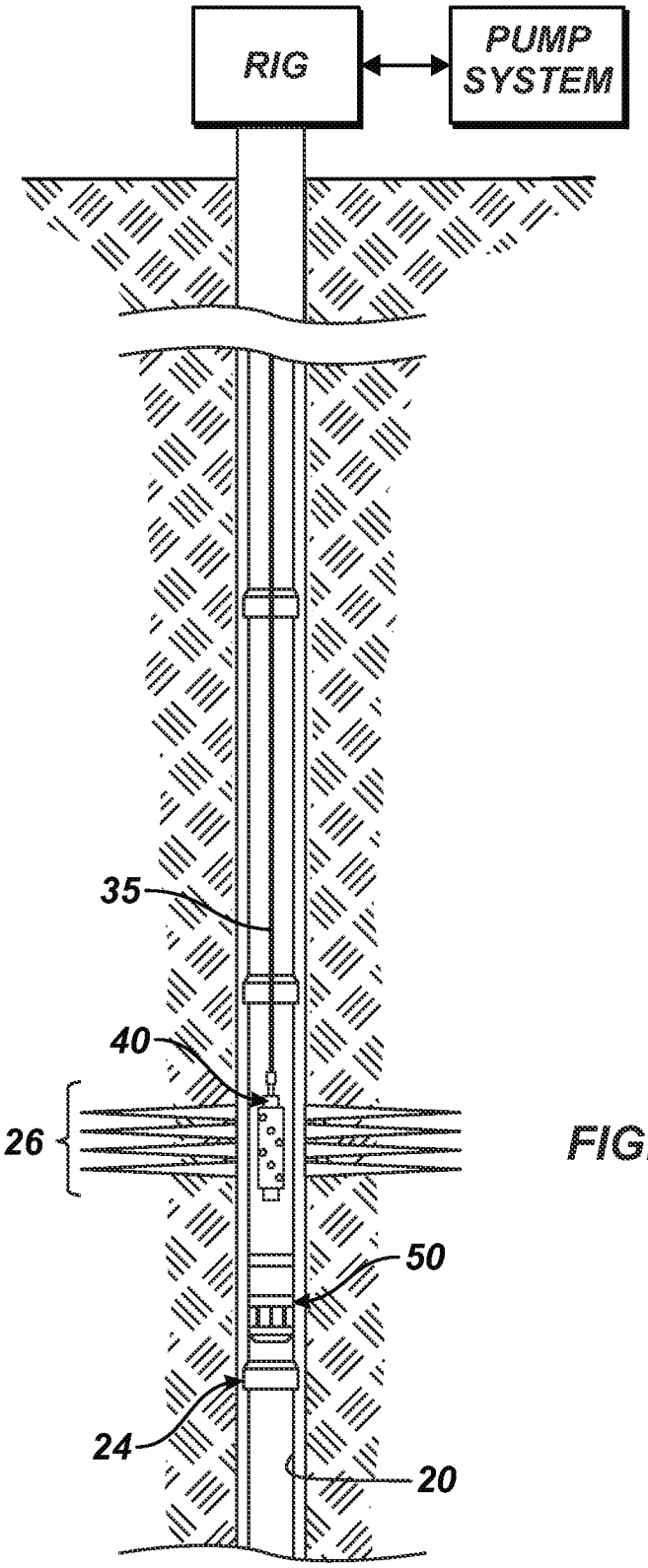
Figure 3F:
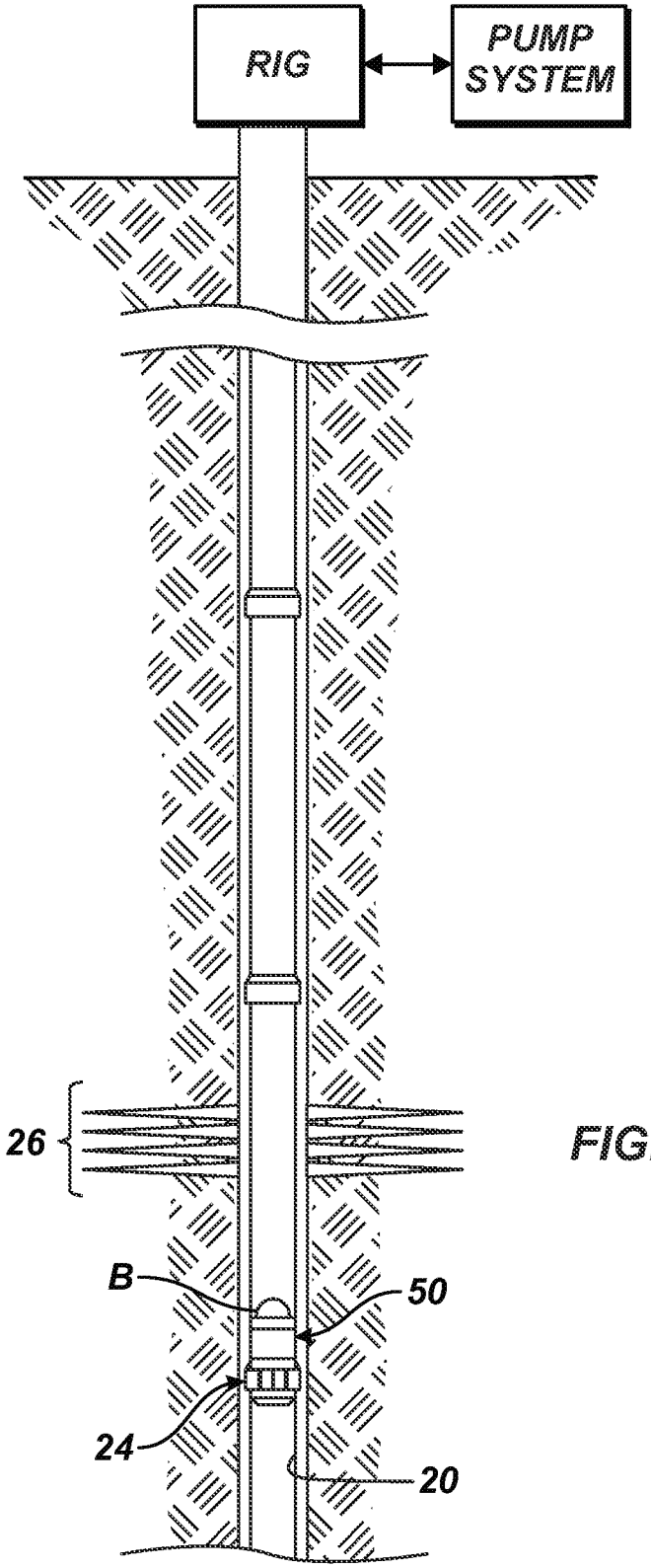

Having the plug 50 dropped off in the casing 20 but not necessarily set in the profile 24 as disclosed in FIG. 3A also allows additional operations to be performed uphole of the plug 50. As shown in FIG. 3E, for example, a perforating gun 40 can be deployed uphole of the plug 50 and can perforate the tubing 20 to form perforations 26. In fact, the perforating gun 40 can be deployed together with the setting tool 30 and plug 50. Once the setting tool 30 released the plug 50, the perforating gun 40 can be moved uphole to perforate the casing 20. In continued steps as shown in FIG. 3F, the gun 40 can be removed, a ball B or the like can be dropped, pumped, etc. downhole to the plug 50, and the surface pump system can pump fracture fluid or other treatment down the casing 20.

The pumped pressure against the seated ball B in the plug 50 pushes against the mandrel 52 so that the blocks 60 engage in the profile 24. Continued pressure activates the packing element 80 to create a pressure seal with the casing 20. While downhole zones are isolated by the set plug 50, the pumped fracture fluid from the rig and pump system can treat the perforated zone uphole of the plug 50. The process of deploying a plug 50, perforating the casing 20, setting the plug 50 in the next profile 24, and fracturing the adjacent zone can be repeated multiple times up the casing 20.

After operations, all of the set plugs 50 and balls B can be milled out using a milling operation. Alternatively, the balls B can dissolve, while the plugs 50 are milled. Still further, both the ball B and plugs 50 can be composed of dissolvable materials. The plug 50 is about 8 to 9 inches in length when used for 5-inch casing 20. This makes the plug 50 shorter than conventionally used and easier to mill. In other alternatives, the set plug 50 can be pulled out of the casing 20. If possible, the balls B can be floated or otherwise removed. Also, the set plug 50 can be pulled by grappling the bottom ends 54 of the plug 50 through the mandrel's bore 53.

It is worth noting that, when pressure applied against the plug 50 is relieved, the plug 50 relaxes. This can allow the pressure to equalize above and below the seal of the packing element 80 to facilitate milling or removal of the plug 50. In an alternative, the plug 50 can be fixed in the set condition using a body lock ring, ratchet mechanism, or other locking feature (not shown) on the mandrel 52 to lock the position of the setting blocks 60 and/or load ring 70 on the mandrel 52 and prevent relaxing of the sealed packing element 80.

It is also worth noting that, although the plug 50 is dropped off in the casing 20 uphole of the profile 24, it may be possible to drop the plug 50 below the desired profile 24. In this situation, the plug 50 would need to be lifted in the casing 20 in a subsequent operation after drop off so the plug 50 could be positioned at the appropriate profile 24. This may be performed at the same time or may require an additional wireline operation.

Dropping off the plug 50 from the deployment tool 30, as noted above, requires the plug 50 to be released from the deployment tool 30 so that the biased setting blocks 60 can expand outward. Various configurations can be used to achieve this.

Figure 4:
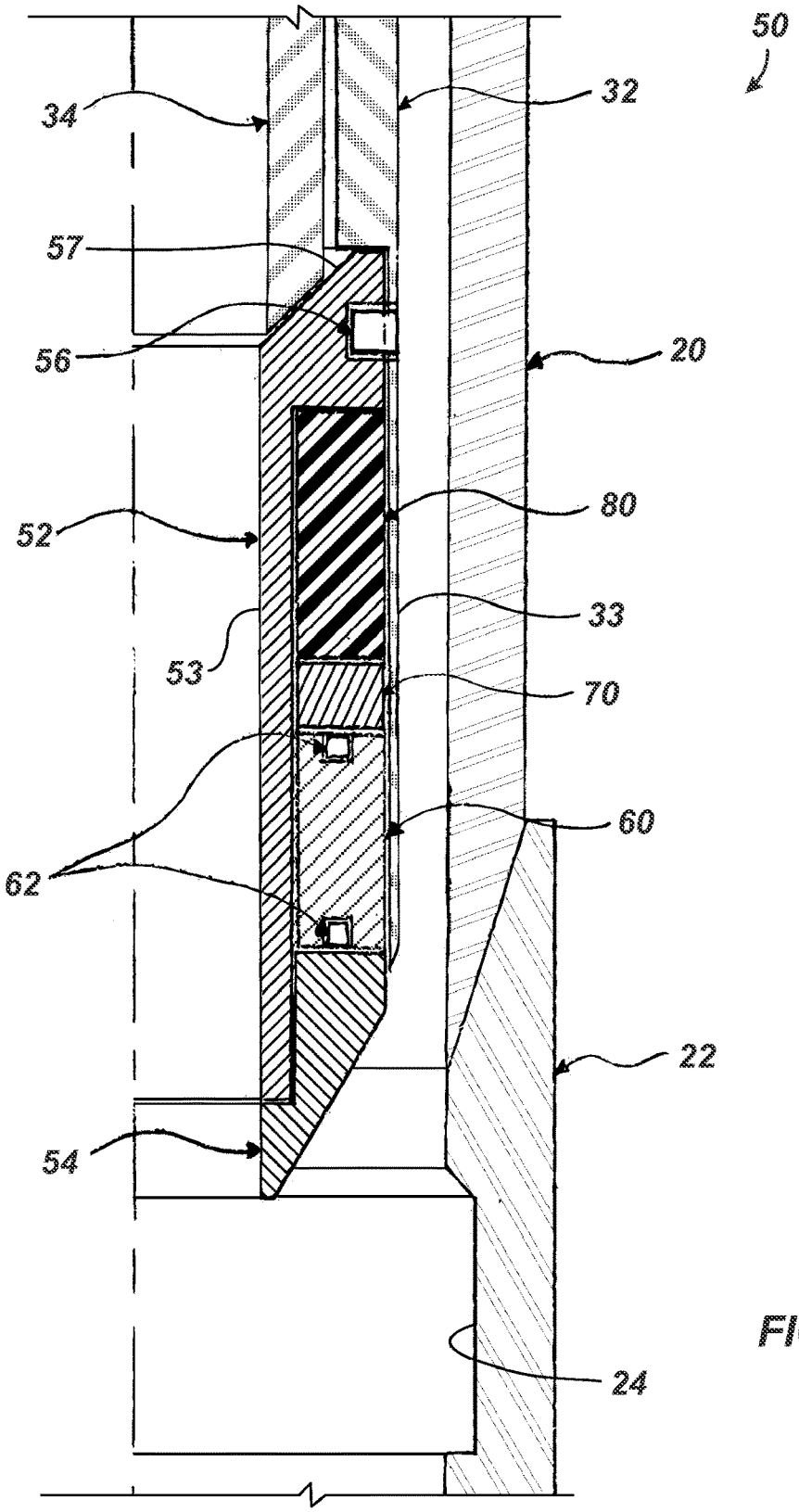
FIG. 4 is a detailed cross-sectional view of the disclosed plug during run-in using a release configuration.

In particular, FIG. 4 is a detailed cross-sectional view of the disclosed plug 50 during run in using one configuration of release components. The deployment tool 30 includes an outer release sleeve 32 and an inner push mandrel 34. Relative movement between the release sleeve 32 and the push mandrel 34 releases the plug 50. As noted herein, the deployment tool 30 can use a charge, hydraulics, or other mechanism to create this relative movement.

The release sleeve 32 has an extension 33 disposed along the outside of the plug 50, holding and protecting the packing element 80, the load ring 70, and the setting blocks 60. The plug's mandrel 52 or some other portion of the plug 50 is affixed to the sleeve 32 or extension 33 to hold the plug 50 on the deployment tool 30. For example, one or more shear screws 56 or other temporary connections can affix the mandrel 52 to the extension 33.

Movement of the release sleeve 32 relative to the push mandrel 34 breaks this temporary connection 56 to release the plug 50. Deploying a conventional plug downhole can involve a great deal of force. Here, however, deploying the plug 50 in the casing 20 would require significantly less than conventional setting forces and may only require about 500-lbs of force.

Once released from the extension 33, the blocks 60 biased by the springs 62 extend outward to the surrounding casing 20. Eventually as described above, the plug 50 can be pushed by a dropped ball (not shown) in the seat 57 and applied pressure to the requisite profile 24 so the plug 50 can be set to seal inside the casing 20.

Should the deployment tool 30 malfunction so that relative movement between the release sleeve 32 and the push mandrel 34 does not release the plug 50, then pumped pressure down the casing 20 can shear the connections 56 and push the plug 50 off of the deployment tool 30. For example, if the deployment tool 30 is an E4 style setting tool, the deployment tool 30 may sometimes not operate properly (e.g., due to a "wet" charge). Rather than having to remove the plug 50 and the deployment tool 30 in order to then redeploy again for setting, operators can instead pump the plug 50 off of the deployment tool 30 by pumping downhole in the casing 20. In this arrangement, the plug 50 can dislodge from the deployment tool 30 by breaking free from the shear connections 56. The plug 50 would then be dropped off in the casing 20 with the blocks 60 biased outward.

Figure 5:
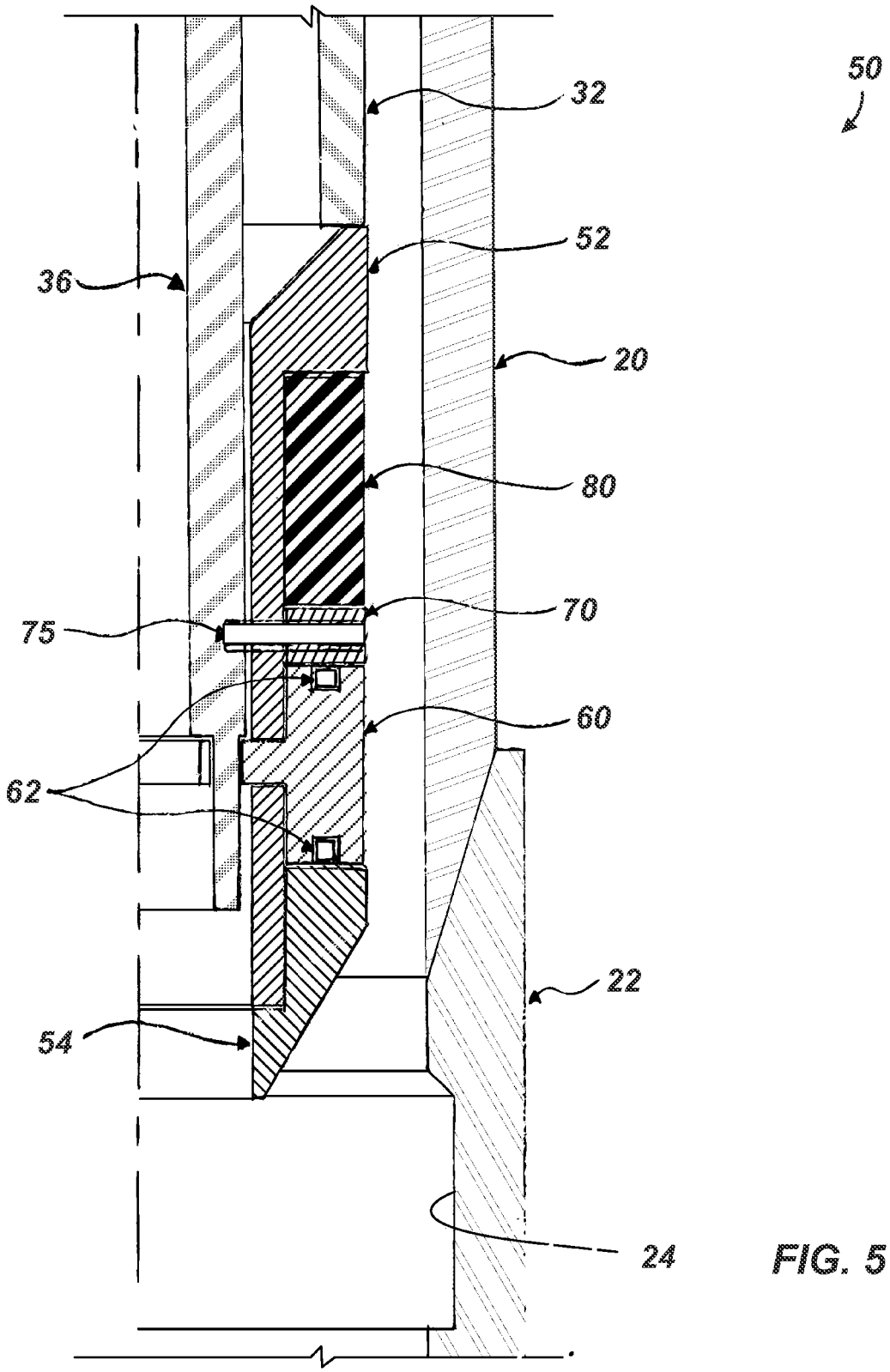
FIG. 5 is a detailed cross-sectional view of another plug during run-in using a release configuration.

FIG. 5 is a detailed cross-sectional view of another plug 50 during run in using another release configuration. Again, the deployment tool 30 has a release sleeve 32. As opposed to a push mandrel, the tool 30 has a tension mandrel 36. Teeth, castellated fingers, or tines 37 visible in FIG. 5 at the end of the tension mandrel 36 affix to inside ends of the blocks 60 and hold them inward. Shear screws 75 or other temporary connections affix the plug's mandrel 52 (and optionally the load ring 70) to the tension mandrel 36.

Movement of the release sleeve 32 relative to the tension mandrel 36 breaks the temporary connection 75 to release the plug 50. Once released from the teeth 37, the blocks 60 biased by the springs 62 extend outward to the surrounding casing 20. Eventually, the plug 50 can be pushed by a dropped ball (not shown) and applied pressure to the requisite profile 24 so the plug 50 can be set to seal inside the casing 20. Should the deployment tool 30 malfunction so that relative movement between the release sleeve 32 and tension mandrel 36 does not release the plug 50, then pumped pressure can shear the connection 75 and push the plug 50 off of the deployment tool 30.

Figure 6:
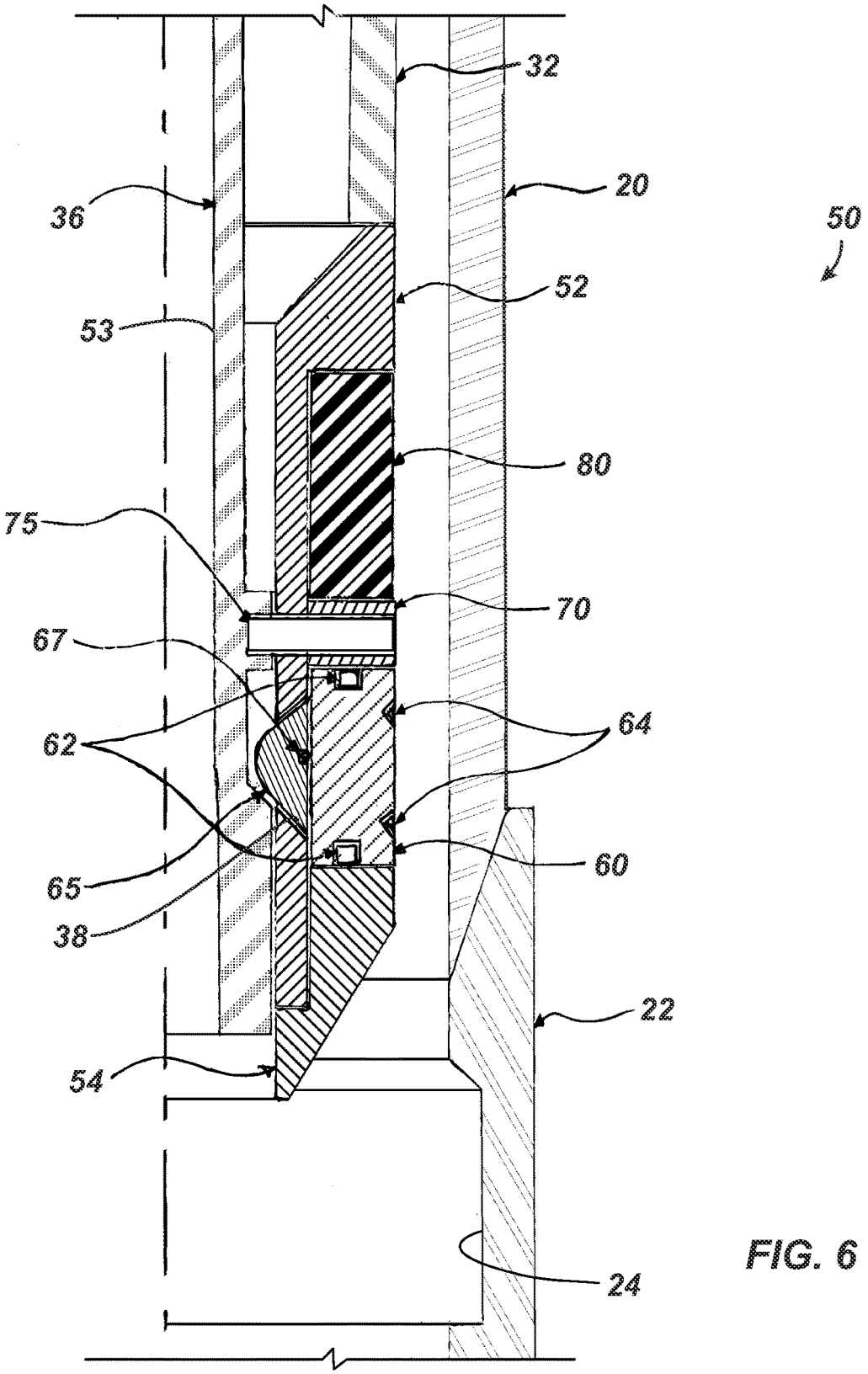
FIG. 6 is a detailed cross-sectional view of yet another plug during run-in using a release configuration.

FIG. 6 is a detailed cross-sectional view of yet another plug 50 during run-in using another release configuration. Again, the deployment tool 30 has a release sleeve 32 and a tension mandrel 36. Retaining rings or bands 64 on the outside of the plug 50 hold the blocks 60 inward where a knob or wedge 65 extends into the mandrel's bore 53. Using shear screws 75 or the like, the tension mandrel 36 is affixed to the plug's mandrel 52 (and optionally the load ring 70) to hold the plug 50 during run-in.

Movement of the release sleeve 32 relative to the tension mandrel 36 breaks this temporary connection 75 to release the plug 50. With the release, a shoulder 38 on the tension mandrel 36 pushes against the inward wedges 65, forcing the blocks 60 outward. The retainer rings 64 break so that the springs 62 bias the blocks 60 outward to engage against the casing 20. Eventually, the plug 50 can be pushed by a dropped ball (not shown) and applied pressure to the requisite profile 24 so the plug 50 can be set to seal inside the casing 20. As before, should the deployment tool 30 malfunction so that relative movement between the release sleeve 32 and then tension mandrel 36 does not release the plug 50, then pumped pressure can shear the connection 75 and push the plug 50 off of the deployment tool 30.

The disclosed plug 50 can be used in a number of operations. As noted above with reference to FIGS. 3A-3F, the plug 50 can be used in plug and perf operations. In such an operation, the plug 50 is dropped off above the desired profile 24 in the casing 20. The casing 20 above the plug 50 is perforated with a perforating gun or other device. The dropped ball B is pumped against the dropped off plug 50, which pushes the plug 50 along the casing 20 until the plug 50 reaches the profile 24. With the lower section of the casing 20 sealed off by the plug 50, fracturing operations can then be performed. Once that zone has been treated, a subsequent plug 50 can be deployed to the next zone above the next profile 24, and the plug and perf operation can be repeated multiple times up the wellbore.

A number of suitable profiles 24 can be used for engaging the plug 50 downhole. The profile 24 can be included on subs disposed at desired points along the casing 20. Alternatively, a coupling at the joints between stands of casing 20 can include an appropriate profile 24.

As illustrated previously, the profile 24 has an expanded inner diameter compared to the tubing or casing 20. A lower or landing shoulder of the profile 24 can engage the biased blocks 60 of the plug 50 to act as a stop. An upper, ramped shoulder of the profile 24 can act as a transition that allows the blocks 60 to move between extended and retracted conditions depending on how the plug 50 is moved.

Figure 7:
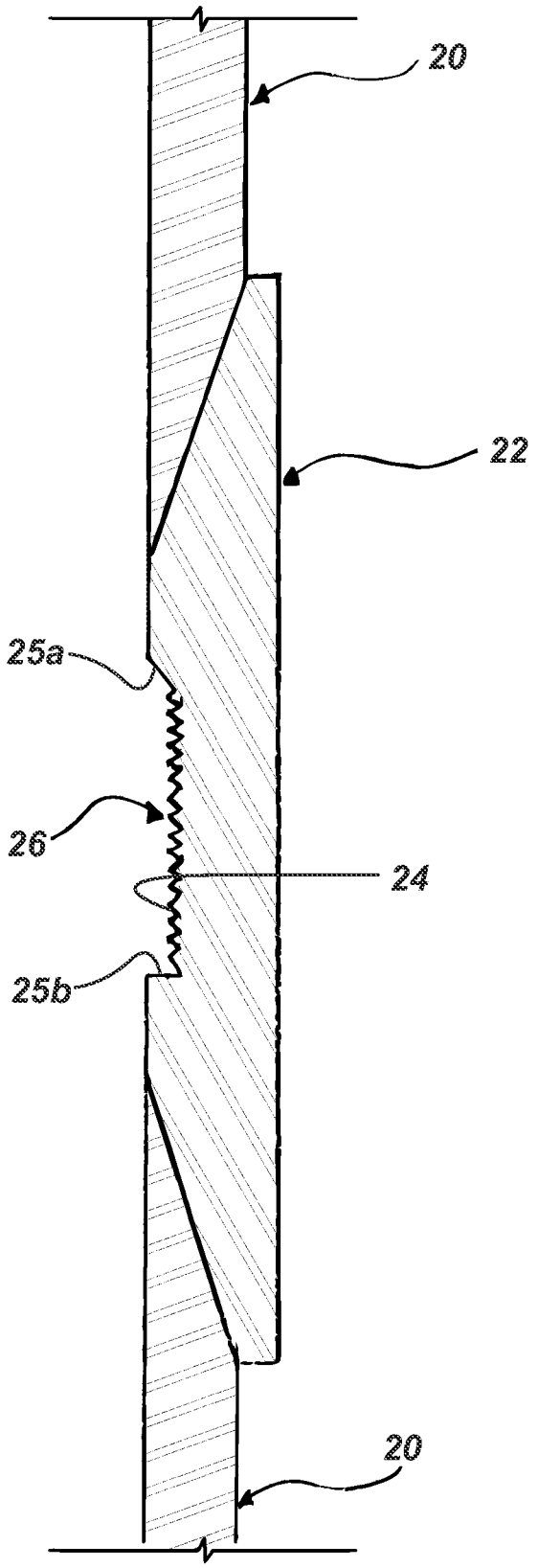
FIG. 7 illustrates an anchor coupling for the present disclosure having an internal engagement surface.

Instead of a uniform profile 24, the profile 24 can include teeth or minor threads. For example, FIG. 7 illustrates an anchor coupling 22 at the joint between stands of casing 20. The coupling 22 includes a profile 24 as disclosed herein with a ramped shoulder 25*a* and a landing shoulder 25*b*. The ramped shoulder 25*a* as noted herein would allow the plug's blocks (60) to slide out of the profile 24 when the plug 50 is pulled uphole. However, the landing shoulder 25*b* acts as a hard stop against which the plug's blocks (60) engage. As a further retention feature for the blocks (60), the inside surface 26 of the profile 24 can include threads, teeth, wickers, serrations, or the like that engage the relatively uniform outer surface of the plug's blocks (60).

As disclosed above, the disclosed plug 50 can be deployed down the tubing or casing string to engage in profiles 24 in subs, anchor couplings, or other components of the tubing string. The disclosed plug 50 can also be used with fracture sleeves and systems. For example, as shown in FIGS. 8A through 9B, the plug 50 can be used in a system in which the disclosed plug 50 opens and seals off inside a single operation sliding sleeve 100 (i.e., a sleeve that stays open after opening).

As shown, the sliding sleeve 100 typically has an inner bore 102 with one or more ports 104 communicating with the borehole annulus for conveying fracture or other treatment fluid to a zone of the wellbore. An insert 110 is movable in the bore 102 relative to the ports 104 to close and open flow therethrough. A profile 112 on the inner surface of the sleeve 110 can engage the deployed plug 50.

Figure 8A:
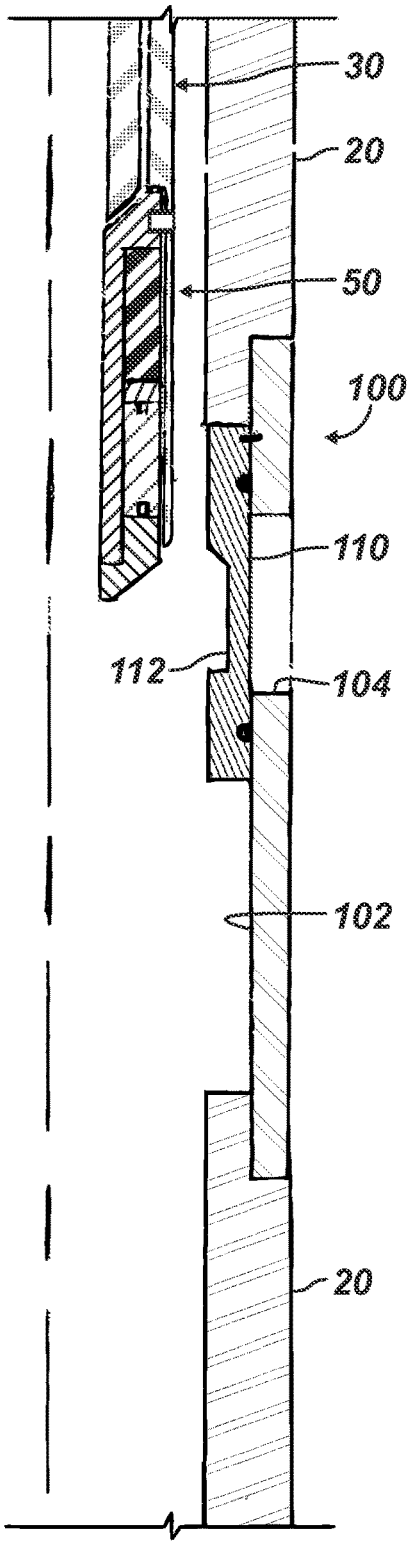
FIGS. 8A-8B and 9A-9B illustrate operation of the disclosed plug in use with a single operation sliding sleeve.
Figure 8B:
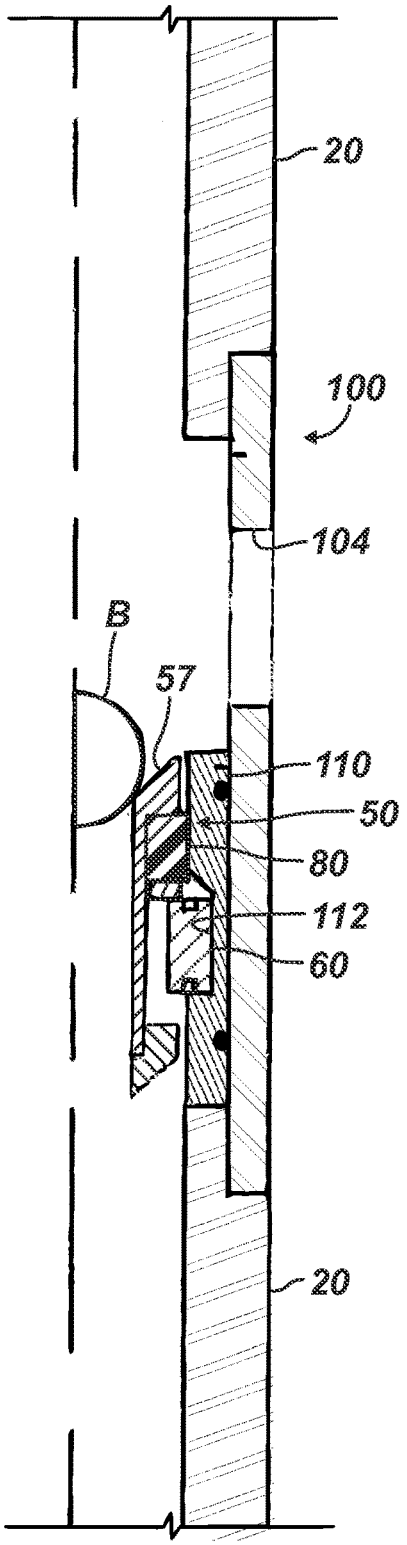
Figure 9A:
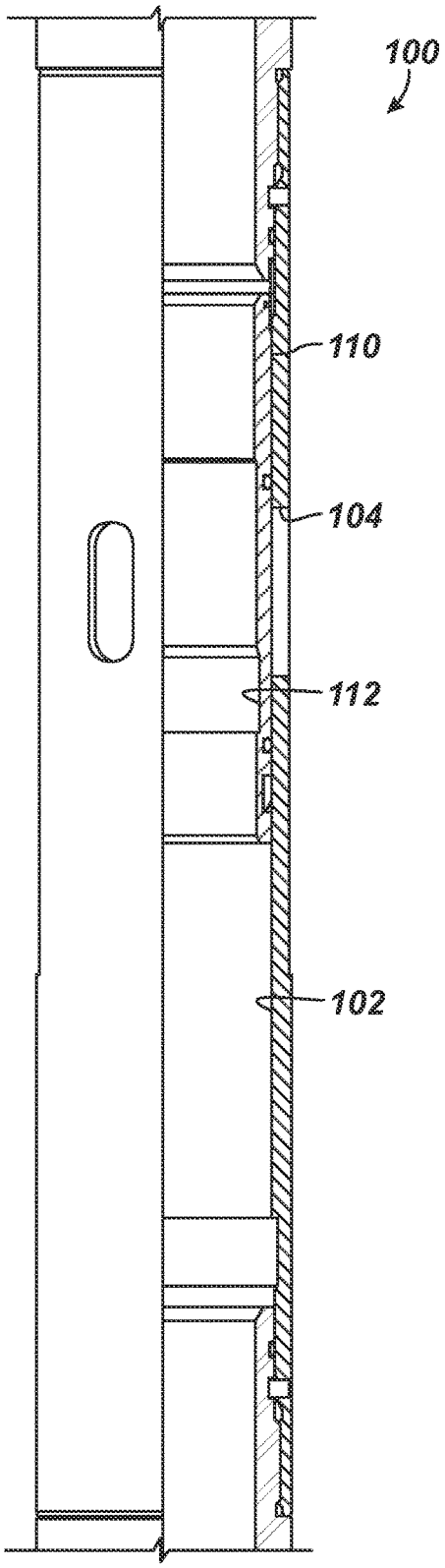
Figure 9B:
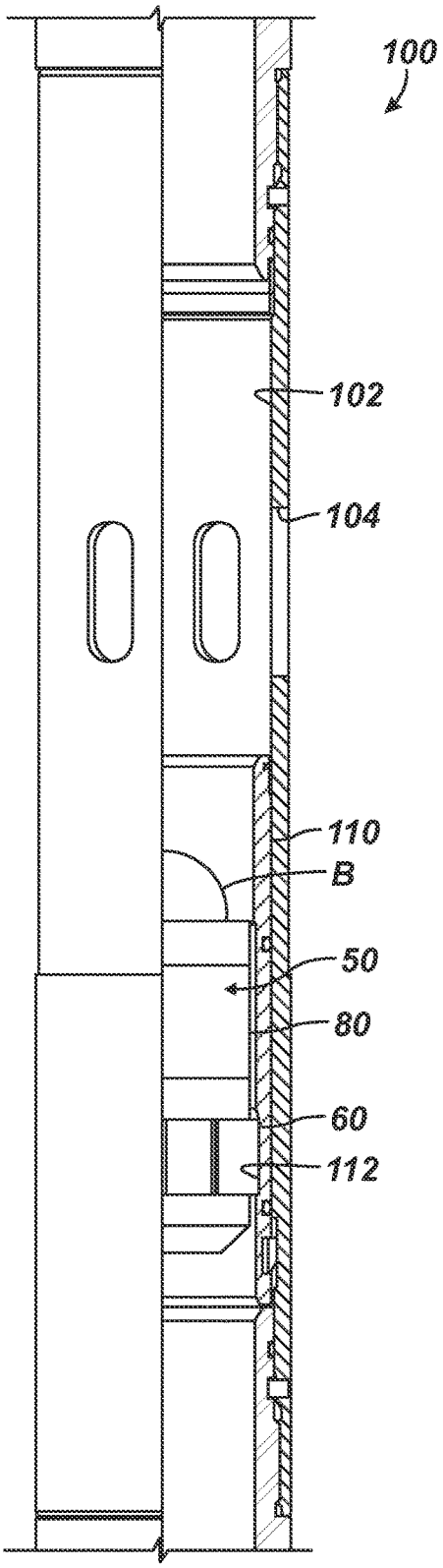

For example, as shown in FIG. 8A, a deployment tool 30, such as disclosed previously, can be used to deploy the plug 50 to a position above the sliding sleeve 100 and can release the plug 50 in the tubing string. Then, a dropped ball B or the like, as shown in FIGS. 8B and 9B, can be deployed downhole to land on the seat 57 of the plug 50, at which point applied fluid pressure against the seated ball B can set the plug 50 in the insert 110. As noted herein, the biased blocks 60 on the plug 50 can engage in the profile 112 of the sleeve 110, and the compressed packing element 80 can seal off fluid flow. The applied pressure against the set plug 50 with seated ball B can then force the insert 110 open so the fluid can pass out the now open ports 104. Once operations are done, the plug 50 and ball B can be milled out, and the insert 110 may or may not be closed depending on the application and whether the insert 110 has a closing profile or the like.

Figures 10A, 10B, 10C:
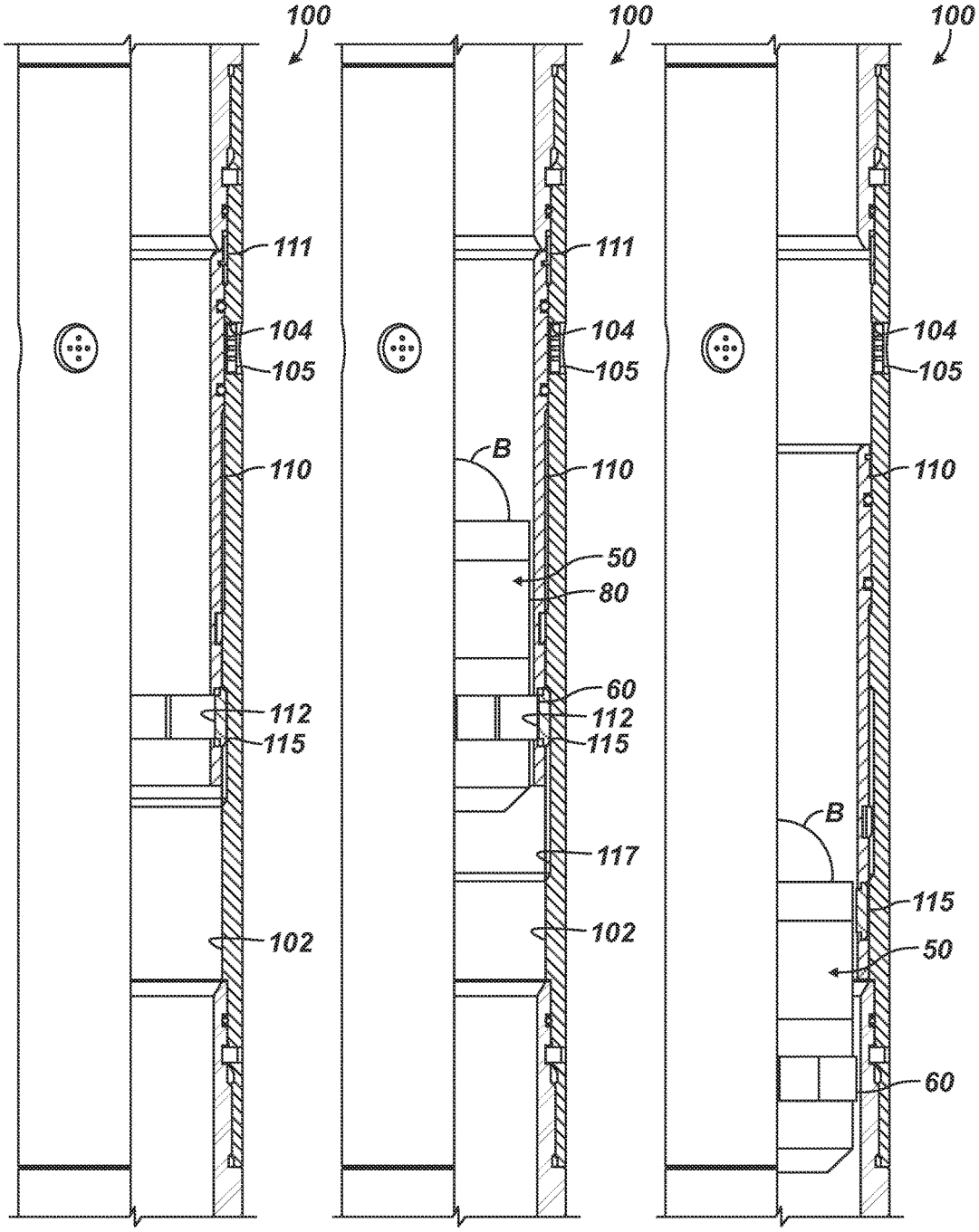

In a similar arrangement, the plug 50 can be used with a system having an array of stimulation sleeves arranged in groups or clusters. For example, FIGS. 10A-100 illustrate operation of the disclosed plug 50 used with a cluster-style sliding sleeve 100. Again, the sliding sleeve 100 typically has an inner bore 102 with one or more ports 104 communicating with the borehole annulus for conveying fracture or other treatment fluid. An insert 110 is movable in the bore 102 relative to the ports 104 to close and open flow therethrough. A profile 112 on the inner surface of the insert 110 can engage the deployed plug 50.

Several of these sleeves 100 can be placed between isolation packers or cemented in place on a tubing or casing string when used in multistage completions. The cluster-style sleeve 100 functions with applied hydraulic pressure, similar to the single operation sliding sleeve disclosed above. However, several of the cluster-style sleeves 100 are intended to be actuated with a single ball B and plug 50 dropped to the cluster or groups of sleeves 100. This configuration emulates a limited-entry perforation (LEP) or a plug-and-perforate cluster stimulation.

In one implementation, a cluster on the casing string can use two different sleeves, including one or more first sleeves 100 that after opening allows the plug 50 to pass through it and down to the next sleeve and including a second sleeve that catches the plug 50 and holds it after opening. The one or more first sleeves 100 have a profile that, once the sleeve's insert 110 has shifted, would direct the blocks 60 inward and allow the plug 50 to slide into the casing 20. The plug 50 can then pass through to the next sleeve, which can be another of the first sleeves 100 to do the same thing or can be the second sleeve—to catch the plug 50 to provide isolation of a fracture operation.

In another implementation, a cluster on the casing string has one or more of the first sleeves 100 and has an anchor sub or the like with a suitable profile downhole of the one or more first sleeves 100. As before, the one or more first sleeves 100 after opening can allow the plug 50 to pass through it and down to the next sleeve (if present). After opening and passing through the one or more first sleeves 100, the plug 50 can then reach the anchor sub or the like having the appropriate profile below the last sleeve in the cluster. This can eliminate concerns of putting the wrong sleeve in the wrong place along the casing 20.

A number of configurations can be used so that the profile in the sleeve's insert 110 would direct the blocks inward after opening and would allow the plug 50 to then slide further downhole in the casing. For example, an inner ledge can disengage the blocks 60 from the profile when the insert 110 has moved open. As shown in FIG. 10A, for example, the sleeve 100 in the closed position can have a recessed profile in the insert 110 created by dogs 115 for the profile 112 in the insert 110 being recessed. According to procedures previously described, a plug 50 is deployed above the sleeve 100 and dropped off, and the ball B is dropped to the plug 50. Moved by fluid pressure, the plug 50 sets in the insert 110 with the blocks 60 fitting in the recessed profile 112 created by the recessed dogs 115, as shown in FIG. 9B.

Continued pressure compresses the packing element 80 in the insert 110, and the pressure against the plug 50 releases the insert 110 from any retention features 111. The insert 110 then moves in the bore 102 of the sleeve 100. At some point, the dogs 115 are pushed inward when reaching a change in internal dimension. The pushed dogs 115 eliminate the profile for the blocks 60 so there is no longer a sufficient shoulder for the blocks 60 to engage.

Now disengaged, the blocks 60 release from the insert 110, and the plug 50 and ball B can pass on to the next cluster-style sleeve 100 further downhole (if present). The process of engaging the plug 50, opening the sleeve 100, and releasing the plug 50 repeats until the plug 50 reaches a single operation sleeve, an anchor sub, or the like as already discussed, which would not allow the plug 50 to pass further downhole.

Because several cluster-style sleeves 100 are opened in succession, port diffusers 105 are installed in the sleeve's ports 104 as temporary obstruction to normalize the pressure drop, ensuring that all of the cluster-style sleeves 100 in the group can be actuated. Any plugs 50 and balls B in the sleeves 100 can be readily milled out to provide fullbore passage of tools for other operations. Once opened, the sliding sleeves 100 may be closeable, or they may lock in open position so they cannot be reclosed.

Figure 11A:
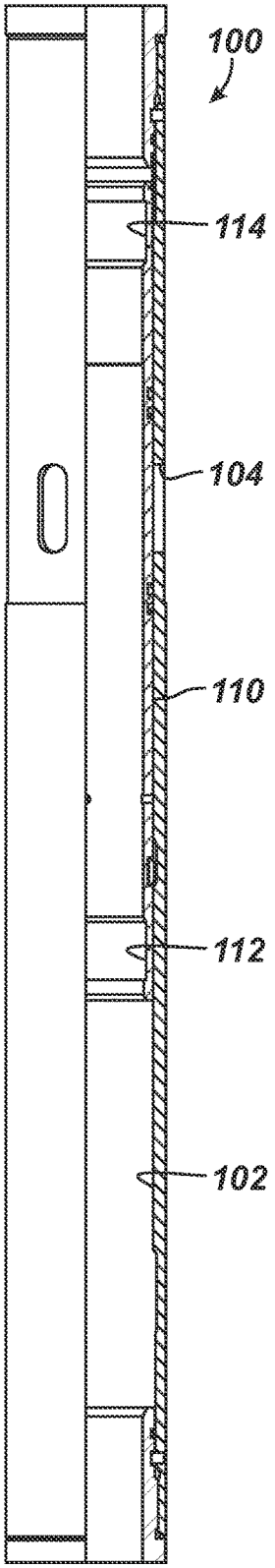
FIGS. 11A-11C illustrate operation of the disclosed plug in use in a refracture operation with a sliding sleeve.
Figure 11B:
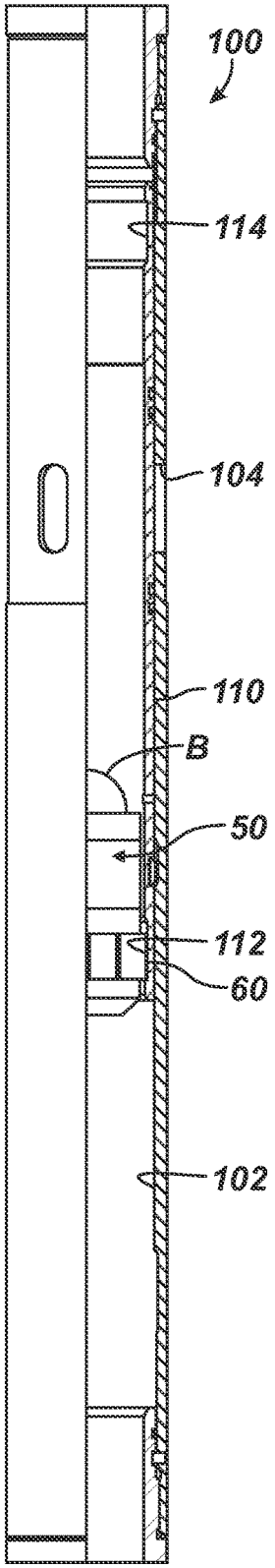
Figure 11C:
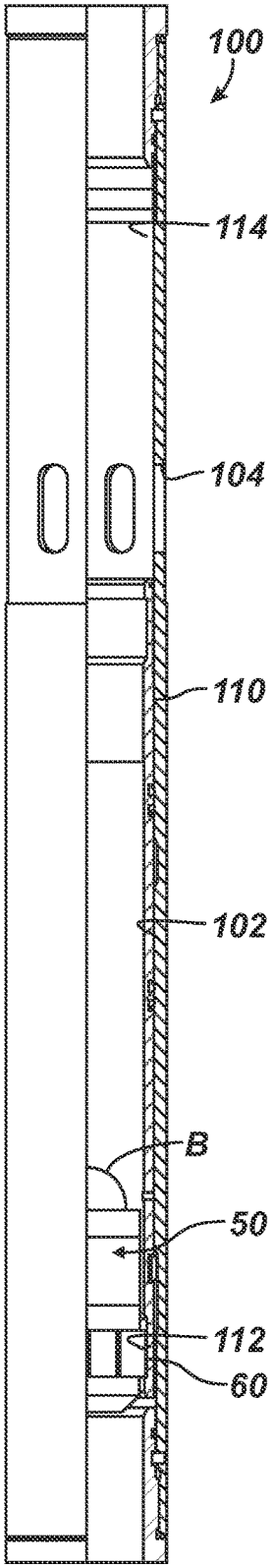

In addition to the above operations, the plug 50 can be used in refracture operations to plug and open a closed sliding sleeve so the adjacent zone can be refractured. For example, FIGS. 11A-11C illustrate operation of the disclosed plug 50 in use for a refracture operation with a sliding sleeve 100.

In this implementation, a sliding sleeve 100 has a conventional insert 110 with or without a ball seat (not shown). This sleeve 100 can be run on the tubing or casing string. For the initial fracture operation, a ball can be deployed to open the insert 110 of the sleeve 100 if a ball seat is present. Otherwise, the insert 110 can be opened with a shifting tool (not shown) engaging a shifting profile 112, or the insert 110 can be opened with a deployed plug 50 and ball B as disclosed herein engaging the shifting profile 112.

Either way, once the sleeve 100 is opened, initial fracture treatment can be applied to the adjacent zone through the open ports 104 in the sliding sleeve 100. The ball and seat (if present) or the plug 50 and ball B (if used) can then be milled out in a milling operation. The insert 110 can then be mechanically closed using a shifting tool in the closing profile 114 so that the sliding sleeve 100 is in the closed position as shown in FIG. 11A.

At some point, a refracture operation may be needed to stimulate the adjacent zone again. In this instance, a plug 50 is dropped off above the sleeve 100, and the ball B is dropped to the plug 50. Applied pressure can then pump the plug 50 and seated ball B to the insert 110, which has the appropriate opening profile 112. Once the plug 50 is set as shown in FIG. 11B in the profile 112, increased pressure can then reopen the sleeve's insert 110. While the plug 50 seals off in the insert 110, refracture treatment can be performed through the opened ports 104, as shown in FIG. 11C. Again, once treatment is done, the plug 50 and ball B can be milled out in a milling operation, and the insert 110 can be mechanically closed using the closing profile 114.

Figure 12:
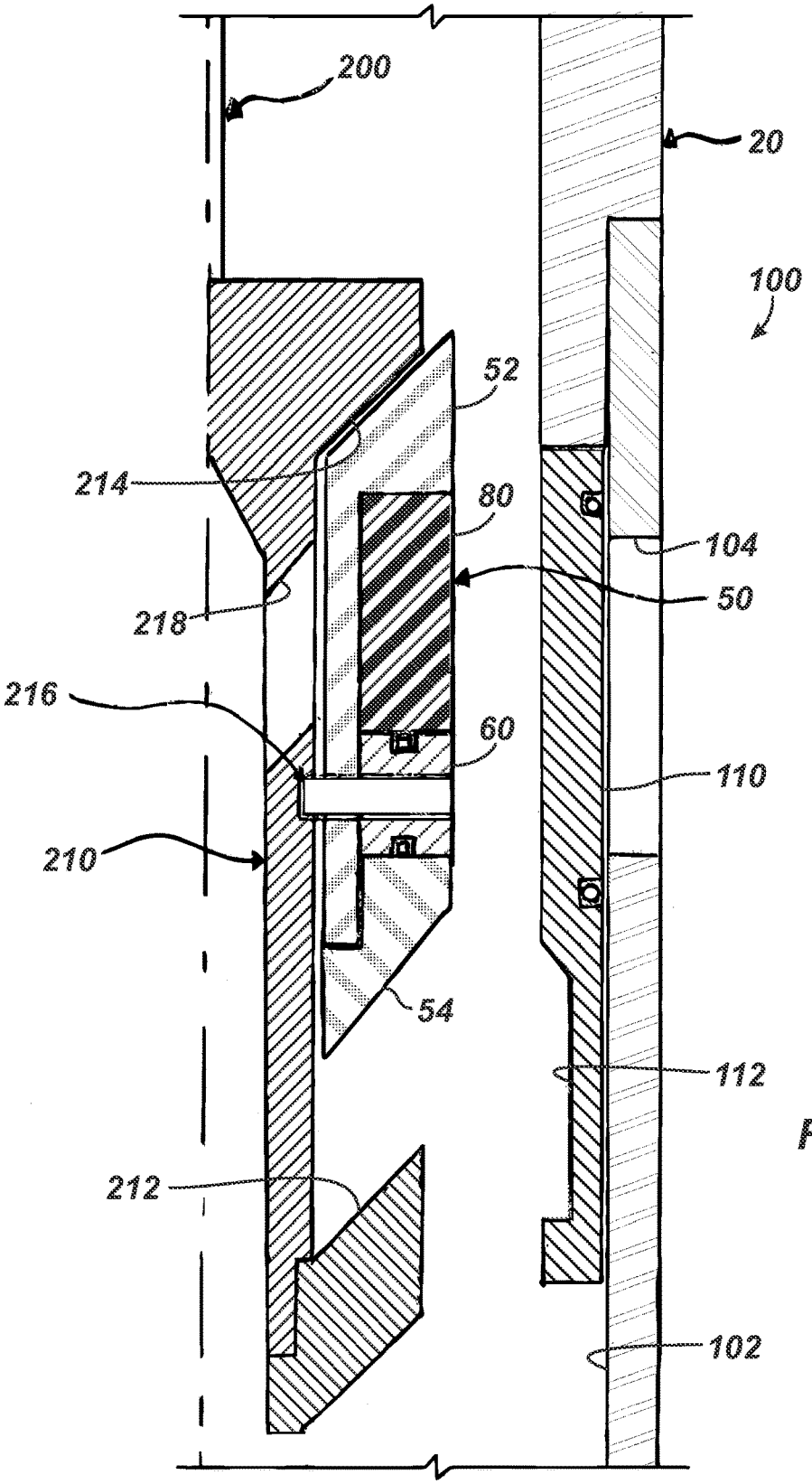
FIG. 12 illustrates the disclosed plug used with a slickline and a body mandrel in operation with a sliding sleeve.

Finally, FIG. 12 illustrates the disclosed plug 50 used with a slickline 200 and a body mandrel 210 in operation with a sliding sleeve 100. The body mandrel 210 is disposed on the end of the slickline 200 or similar conveyance used to manipulate the body mandrel 210 in the tubing or casing string. The plug 50 is movably disposed on the body mandrel 210, being retained between lower and upper ramped shoulders 212 and 214. The plug 50 is initially retained with one or more shear screws 216 that affix the plug's mandrel 52 to the body mandrel 210. The screws 216 may also retain the setting blocks 60 on the plug 50, although any of the other configurations disclosed herein can be used.

The plug 50 is initially manipulated downhole to the sliding sleeve 100, which may typically be the deepest one along the tubing string. The plug 50 is then sheared free from the shear screw 216 so that the plug 50 can move on the body mandrel 210 between the ramped shoulders 212 and 214. For example, pumped fluid can release the plug 50 on the mandrel 210 by shearing the plug 50 free of the shear screw 216.

At this point, the blocks 60 on the plug 50 are biased outward so that they will tend to engage in the profile 112 of the sliding sleeve's insert 110 as the slickline 200 manipulates the plug 50 and the body mandrel 210 further into the sliding sleeve 100. With the blocks 60 engaged in the profile 112, continued downhole manipulation of the slickline 200 forces the upper ramped shoulder 214 against the plug's mandrel 52 as the blocks 60 remain fixed in the profile 112 and the packing element 80 packs off in the insert 110. Further downhole manipulation (and applied pressure if desired) can then open the insert 110 on the sliding sleeve 100 so that treatment fluid can pass out the open ports 104. All the while, the plug 50 with its set blocks 60 and compressed packing element 80 pushed by the body mandrel 210 can close off further downhole portions of the tubing string.

Once treatment is done, the slickline 200 is manipulated uphole so that the lower ramped shoulder 212 catches the plug 50. Fluid pressure above the plug 50 can now pass through the now exposed bypass 218 in the body mandrel 210 to equalize pressure. The packing element 80 is uncompressed, and the blocks 60 slide free of the profile 112 along its slanted upper shoulder. The slickline 200 and plug 50 can then be manipulated further uphole to above the next sliding sleeve 100 along the tubing string, and the same operation can be repeated.

To prevent engaging the blocks 60 while lifted with the slickline 200, any changes in dimensions or shoulders in the tubing string would need to let the blocks 60 pass. Once set above the next sliding sleeve, the opening and treatment operations can be repeated. The entire procedure can then be performed multiple times along the tubing string.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

As disclosed herein, the plugs 50 have included throughbores 53 and seats 57 requiring a separate ball B or similar type of component to close off fluid communication. This arrangement may be preferred for certain operations so the plug 50 does not set prematurely, so the plug 50 can be set when desired, so the plug 50 allows flow back therethrough, etc. It is possible in other implementations to use a solid plug 50 that lacks a throughbore 53 and does not require landing of a ball or the like. Use of such a solid plug 50 would follow readily recognizable alterations to the previous embodiments that disclosed a plug 50 with throughbore 53 for use with a ball B or the like.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A downhole apparatus for a wellbore tubular having an uphole-facing shoulder, the apparatus comprising:

a plug having a body, a setting element, and a packing element, the body having an exterior surface and having downhole and uphole ends, the setting element disposed on the body toward the downhole end and having a downhole-facing shoulder, a deployment tool deploying the plug in the wellbore tubular and holding the setting element at least temporarily in a retracted condition against the exterior surface, the deployment tool being removable from the plug at a point in the wellbore tubular uphole of the uphole-facing shoulder, the removed deployment tool releasing the plug at the point in the wellbore tubular and releasing the hold on the setting element, the released setting element being biased to an expanded condition away from the exterior surface toward the wellbore tubular, the downhole-facing shoulder of the released setting element in the extended condition being engageable in a downhole direction with the uphole-facing shoulder in the wellbore tubular and being movable with the engagement in an uphole direction toward the uphole end, the packing element disposed on the body toward the uphole end and adjacent the setting element, the packing element being compressible from an unsealed condition to a sealed condition between the body and the released setting element moved in the uphole direction by engagement of the downhole-facing shoulder with the uphole-facing shoulder, the uncompressed packing element in the unsealed condition being unsealed with the wellbore tubular, the compressed packing element in the sealed condition being sealed with the wellbore tubular and isolating an annulus between the body and the wellbore tubular.

2. The apparatus of claim 1, further comprising a load ring disposed on the body between the packing element and the setting element.

3. The apparatus of claim 2, wherein the load ring comprises a temporary fixture to the body.

4. The apparatus of claim 1, wherein the setting element comprises inner and outer surfaces, the inner surface facing the exterior surface of the body, at least one biasing element circumferentially biasing the setting element away from the exterior surface.

5. The apparatus of claim 1, wherein the body defines a bore therethrough from the downhole end to the uphole end.

6. The apparatus of claim 5, wherein the uphole end comprises a seat against which a deployed element engages and closes off fluid communication through the bore.

7. The apparatus of claim 1, wherein the setting element comprises a plurality of ring segments disposed about the body.

8. The apparatus of claim 1, wherein the body of the plug is composed of at least one of a millable material, a non-metallic material, a molded phenolic, a laminated non-metallic composite, an epoxy resin polymer with a glass fiber reinforcement, a thermoplastic material, an injection-molded plastic material, a metal, a dissolvable material, and a degradable material; wherein the setting element of the plug is composed of at least one of a millable material, a non-metallic material, a molded phenolic, a laminated non-metallic composite, an epoxy resin polymer with a glass fiber reinforcement, a thermoplastic material, an injection-molded plastic material, a metal, a dissolvable material, and a degradable material; and wherein the packing element is composed of an elastomeric material.

9. The apparatus of claim 1, wherein the deployment tool comprises first and second components, the first component engaging the body, the second component engaging the body and holding the setting element in the retracted condition, at least one of the first and second components being movable relative to the other and releasing the body in the wellbore tubular, the setting element unheld by the second component expanding outward in the expanded condition to the wellbore tubular.

10. The apparatus of claim 9, wherein the second component comprises an external sleeve disposed outside of the setting element, the external sleeve being movable along the outside away from the setting element.

11. The apparatus of claim 9, wherein the second component comprises a temporary fixture to the body.

12. The apparatus of claim 9, wherein the second component comprises an internal mandrel disposed inside a bore of the body and holding against an interior portion of the setting element, the internal mandrel being movable along the inside of the bore away from the interior portion of the setting element.

13. The apparatus of claim 9, wherein the setting element comprises a temporary fixture holding the setting element in the retracted condition; and wherein the second component comprises an inner mandrel disposed inside a bore of the body and engaging an interior portion of the setting element, the inner mandrel movable along the inside of the bore and pushing the interior portion of the setting element, the pushed setting element breaking the temporary fixture and expanding outward to the wellbore tubular in the expanded condition.

14. The apparatus of claim 1, further comprising:

a coupling disposed on the wellbore tubular and having an internal profile with the uphole-facing shoulder, wherein the plug is run into the wellbore tubular and engages in the internal profile of the coupling.

15. The apparatus of claim 14, wherein the internal profile of the coupling defines a serrated wall.

16. The apparatus of claim 14, wherein the deployment tool runs the plug into the wellbore tubular and releases the plug at a point uphole of the coupling, wherein movement of the released plug in a downhole direction engages the plug with the uphole-facing shoulder.

17. The apparatus of claim 1, further comprising:

at least one sleeve disposed on the wellbore tubular and having an external port communicating outside the at least one sleeve, the at least one sleeve having an insert movable therein relative to the external port, the insert having an internal profile with the uphole-facing shoulder of the wellbore tubular, wherein the plug runs into the wellbore tubular to the at least one sleeve and engages in the internal profile of the insert, and wherein movement of the plug engaged in the internal profile moves the insert relative to the external port.

18. The apparatus of claim 17, wherein the internal profile of the insert has first and second conditions, the internal profile in the first condition engageable with the plug such that movement of the plug in one direction moves the insert in the one direction, the internal profile in the second condition disengageable with the plug such that the plug moves independent of the insert.

19. The apparatus of claim 17, wherein the internal profile comprises a key movable between the first and second conditions in a slot of the insert, the key in the first condition retracted out from the slot to expose the shoulder for engagement with the plug, the key in the second condition placed into the slot to remove exposure of the shoulder.

20. The apparatus of claim 17, wherein the external port comprises a temporary obstruction disposed therein at least temporarily limiting fluid communication outside of the sleeve.

21. The apparatus of claim 17, wherein the setting deployment tool comprises:

a mandrel supported on a conveyance and supporting the plug on an exterior thereof, the mandrel having first and second ends and defining an intermediate passage communicating the exterior between the first and second ends with the first end of the mandrel.

22. The apparatus of claim 21, wherein the plug is temporarily held to the exterior of the mandrel and releases therefrom with fluid communicated against the plug.

23. The apparatus of claim 22, wherein the plug released from the mandrel is engageable with the internal profile of the insert; and wherein movement of the plug with the conveyance in a downhole direction against the shoulder of the internal profile slides the insert relative to the external port.

24. The apparatus of claim 23, wherein movement of the plug with the conveyance in an uphole direction away from the internal profile releases the plug therefrom; and wherein passage of fluid against the plug and through the intermediate passage maintains the plug against the downhole end and maintains the packing element on the plug unset.

25. A method of plugging a wellbore tubular, comprising:

deploying a plug to a point in the wellbore tubular with a deployment tool temporarily holding a setting element on the plug in a retracted condition on the plug;

releasing the plug and the setting element from the deployment tool in the wellbore tubular;

at least temporarily supporting the plug at the point in the wellbore tubular by the released setting element in an extended condition on the deployed plug engaging the wellbore tubular;

engaging a downhole-facing shoulder of the extended setting element in a downhole direction against an uphole-facing shoulder near the point in the wellbore tubular; and compressing a packing element on the plug against the engaged setting element by moving the plug in the downhole direction.

26. The method of claim 25, wherein deploying the plug to the point in the wellbore tubular comprises running the plug in the wellbore tubular with the deployment tool on a conveyance.

27. The method of claim 25, wherein releasing the setting element temporarily held in the retracted condition to the extended condition on the deployed plug comprises disengaging a portion of the deployment tool from temporarily holding the setting element.

28. The method of claim 25, wherein engaging the extended setting element in the downhole direction in the profile against the shoulder near the point in the wellbore tubular comprises seating an element at a bore of the plug, and pumping fluid against the plug with the seated element.

29. The method of claim 25, wherein compressing the packing element on the plug against the engaged setting element by moving the plug in the downhole direction comprises: moving the engaged setting element in an uphole direction along the plug; compressing the packing element from an unsealed condition with the wellbore tubular to a sealed condition with the wellbore tubular, and isolating an annulus between the body and the wellbore tubular.

* * * * *